US005703622A

United States Patent [19]

Evans et al.

[11] Patent Number: 5,703,622

[45] Date of Patent: Dec. 30, 1997

[54] METHOD FOR IDENTIFYING VIDEO PIXEL DATA FORMAT IN A MIXED FORMAT DATA STREAM

[75] Inventors: Edward Kelley Evans, Essex Junction; Roderick Michael Peters West, Colchester, both of Vt.

[73] Assignee: International Business Machines Corporation, Armonk, N.Y.

[21] Appl. No.: 380,763

[22] Filed: Jan. 30, 1995

[51] Int. Cl.[6] ..... G09G 5/04

[52] U.S. Cl. ..... 345/154; 345/115; 345/132; 395/514; 348/600; 348/716

[58] Field of Search ..... 395/154, 162, 395/164, 165, 509, 521, 514; 345/113, 115, 132, 153, 154, 155, 189, 190; 348/600, 589, 716

[56] References Cited

U.S. PATENT DOCUMENTS

| | | | |
|---|---|---|---|
| 4,789,854 | 12/1988 | Ishii | 340/703 |
| 4,800,380 | 1/1989 | Lowenthal et al. | 340/750 |
| 4,979,738 | 12/1990 | Frederiksen | 345/132 |
| 5,241,658 | 8/1993 | Masterson et al. | 345/155 |
| 5,243,447 | 9/1993 | Bodenkamp et al. | 345/133 |
| 5,301,272 | 4/1994 | Atkins | 395/165 |
| 5,473,342 | 12/1995 | Tse et al. | 345/132 |

FOREIGN PATENT DOCUMENTS

| | | |
|---|---|---|
| A-0601647 | 3/1993 | European Pat. Off. . |
| WO89/01218 | 2/1989 | WIPO . |

*Primary Examiner*—Regina D. Liang
*Assistant Examiner*—Kara Farnandez Stoll
*Attorney, Agent, or Firm*—Dale M. Crockatt; Susan M. Murray

[57] ABSTRACT

A method and apparatus for a computer graphics system identifies the format of video pixel data in a data stream having a plurality of data formats including a first pixel data format and a second pixel data format, the second pixel data format being a YUV format. The method comprises the steps of (a) receiving pixel data; (b) selecting an output channel in response to at least one particular value of at least one bit of each received pixel datum wherein the particular value identifies the data format as either the first pixel data format or the YUV format; and (c) providing the pixel data to the selected output channel. Also provided is a circuit in a video graphics controller and a computer system having such circuit according to the method.

6 Claims, 1 Drawing Sheet

METHOD FOR IDENTIFYING VIDEO PIXEL DATA FORMAT IN A MIXED FORMAT DATA STREAM

BACKGROUND OF THE INVENTION

1. Field of the Invention

The present invention generally relates to video processing in a computer system, and more particularly, to a method and apparatus for identifying the format of video pixel data in a data stream potentially having a plurality of data formats.

2. Discussion of the Related Art

With reference to FIG. 1 there is shown an exemplary conventional advanced computer graphics system 1. Pixel data generated by CPU 2 is provided to frame buffer (or display memory) 4, which passes the pixel data to an interface circuit 6 for further processing.

It is desirable for the interface circuit 6 of such an advanced computer graphics system, also known as a palette DAC, to be able to process pixel data which may be presented to the palette DAC 6 in any one or more of a plurality of data formats. As used herein, by palette DAC is meant any such interface circuit 6, or RAM DAC, as such devices are understood in the art. Such plurality of video pixel data formats presented to the palette DAC may include the YUV, RGB, and CLUT formats. In turn, the palette DAC device 6 processes the pixel data and then converts such data into analog signals that drive a display device such as a CRT or signals that are output to a liquid crystal display (LCD).

In most conventional graphics applications, such as spreadsheets, word processors, and editors, 8 bpp (bit per pixel) video pixel data is presented to the palette DAC device 6. The 8 bits of data for each pixel are generally used as an index into a 256-entry color look-up table (CLUT), also known as a palette. This provides, through the 256 entry CLUT, the selection of 256 different active colors out of the total number of colors available in the graphics system, usually 16.8 million. Because this type of pixel data uses 8 bits for each pixel to index colors from a CLUT, it is often referred to as "8 bpp Indexed Color", or commonly as "CLUT8".

Similarly, other indexed color formats are known, such as "CLUT4", a 4 bpp 16 entry CLUT format, and "CLUT12", a 12 bpp 4096 entry CLUT format. None of the above conventional 8 bpp graphics applications require a large number of colors. Indeed, most of these applications can be run acceptably using only 16 colors or even less. In many cases, it is desirable to run these applications with as few bits per pixel as possible, so that the update performance is maximized for any given available system bandwidth.

Many graphics systems operate at 16 bits (2 bytes) per pixel, in the so-called "Hi-Color" mode. Examples of 16 bits per pixel formats are the 565_RGB and 555_RGB pixel data formats. The 565_RGB format is so called because it allocates 5 bits of data to the red and blue color components and 6 bits of data to the green color component, yielding 64K displayable colors but with a bias towards the green component. The 555_RGB format is so called because it allocates 5 bits of data to each of the red, green and blue color components, yielding 32K displayable colors with equal emphasis on each primary color component. Other RGB formats are known, including the 444_RGB format and 332_RGB format, having corresponding data allocation schemes. The 555_RGB format is more commonly used because of its equal weighting of the three primary color components. The 555_RGB format uses only 15 of the available 16 bits for each pixel, leaving the most significant bit (bit 15) unused, with the 15-bit pixel data defined in the least significant 15 bits. Graphics systems operating in the 16 bpp Hi-Color mode can produce excellent color graphics and also display fairly realistic natural images using the 64K or 32K available colors. In addition, some graphics systems operate at 24 bits (3 bytes) per pixel, in the so-called "True-Color" mode. An example of a 24 bpp format is the 888_RGB pixel data format.

However with the advent of digital video, it is desirable to be able to support pixel data in the YUV format.

The YUV format is useful for natural images as it can yield much more realistic color than any conventional graphics format using less than 24 bits for each pixel. The 16 bpp YUV format (4:2:2 YUV) yields natural images of a quality similar to the 24 bpp RGB format, yet requires only two-thirds as much pixel data. Furthermore, the YUV format is the format in which almost all digital video information is encoded and recorded, therefore lack of support for YUV format pixel data in a graphics system will require that the CPU be used to convert the YUV pixel data to a graphics system compatible data format, which is a computationally expensive task and will thus reduce digital video performance. For example, pixel data must be converted to the native data format for a frame buffer which has only one compatible data format.

For a graphics system that supports multiple types of pixel data formats, conventional graphics applications (such as spreadsheets and editors) can be presented simultaneously with natural images and digital video applications on the same display screen. The conventional graphics applications can store pixel data in the CLUT8 format in one or more CLUT8 pixel maps in display memory, and the digital video applications can store pixel data in the YUV format in one or more YUV pixel maps in display memory. However, where the display memory 4, or frame buffer 4, is operating in a single, native data format as is conventional in the art, then all graphics applications must be converted to the compatible native data format by the CPU 2 or additional hardware prior to storage in the display memory 4. Alternatively, separate or additional frame buffers $4_1$–$4_n$ must be used for each separate or additional data type, as depicted in FIG. 2.

Known methods for processing video pixel data, which may be received in a plurality of data formats, are undesirable in that multiple input data ports $P_1$–$P_n$ are required (FIG. 2). This method is very wasteful of pins on the palette DAC device 6 and may cause a higher cost for such a device. Furthermore, separate, dedicated and often duplicative frame buffers $4_1$–$4_n$ are required for each pixel data format. In addition, when the display screen is of high resolution, very high bandwidths are potentially required for each pixel data format, driving up the required pincount to a point beyond economic manufacture.

Alternatively, there is a requirement for conversion of the pixel data into a single native data format in the CPU 2, or in additional hardware, prior to presenting the pixel data to the frame buffer 4 in its compatible format, and subsequently to the palette DAC device 6. It will be appreciated that this is an uneconomical use of CPU capacity, or presents a requirement for additional hardware and complexity.

The following references illustrate the state of the pertinent art.

U.S. Pat. No. 5,301,272 to Atkins, discloses a pixel identification system which includes alpha value assignments in a graphics environment.

U.S. Pat. No. 5,243,447, to Bodenkamp, et. al., discloses a graphics controller which processes video pixel data to translate data having various formats to a uniform output data format which is then presented to a frame buffer.

U.S. Pat. No. 4,800,380 to Lowenthal, et. al., discloses an interface device which combines graphical data and alpha numeric data.

The prior art does not provide a method for overcoming all of the above deficiencies. Thus, there is a need for an improved method for identifying data having differing data formats in a single data stream, and for converting such data to a uniform format.

SUMMARY OF THE INVENTION

An object of the present invention is to provide an improved method, and means for the use thereof, by which RGB and YUV pixel data types which are combined in a single data stream can be distinguished.

Another object of the present invention is to provide an improved method, and means for the use thereof, by which pixel data having a plurality of data formats can be applied to the same input port of a palette DAC device.

Yet another object of the present invention is to provide an improved method, and means for the use thereof, by which pixel data having a plurality of data formats can be received from the same pixel map In a single display memory or frame buffer.

Yet another object of the present invention is to provide an improved method, and means for the use thereof, by which pixel data having a plurality of data formats can be processed in display real time.

Yet another object of the present invention is to provide an improved method, and means for the use thereof, by which pixel data having a first format may be converted to pixel data having a second format in display real time.

Yet another object of the present invention is to provide an improved method, and means for the use thereof, which provides for the economical use of display memory and palette DAC input pins.

Thus, according to the invention, a method and apparatus for identifying the format of video pixel data in a data stream potentially having a plurality of data formats is disclosed.

DETAILED DESCRIPTION OF THE PREFERRED EMBODIMENTS

The present invention provides a method for identifying the format of video pixel data in a data stream comprising the steps of (a) receiving pixel data; (b) selecting an output channel in response to at least one particular value of at least one bit of each said received pixel datum wherein the particular value identifies the data format; and (c) providing said pixel data to said selected output channel. The present invention also provides a circuit in a video graphics controller and a computer system having such circuit according to the method.

Figure 1:
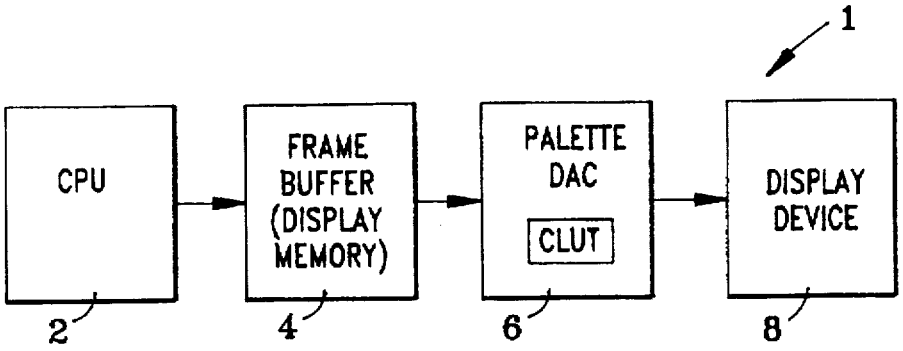
FIG. 1 PRIOR ART
FIG. 1 is a block diagram of a conventional advanced computer graphics system.
Figure 2:
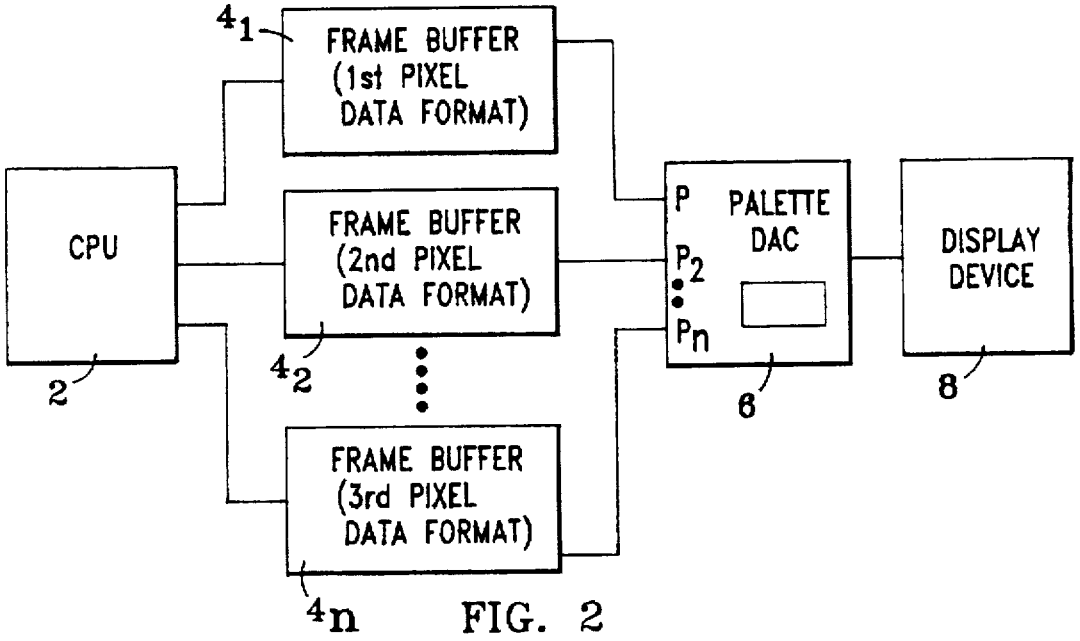
FIG. 2 PRIOR ART
FIG. 2 is a block diagram of an advanced computer graphics system which supports multiple pixel data formats using multiple frame buffers.
Figure 3:
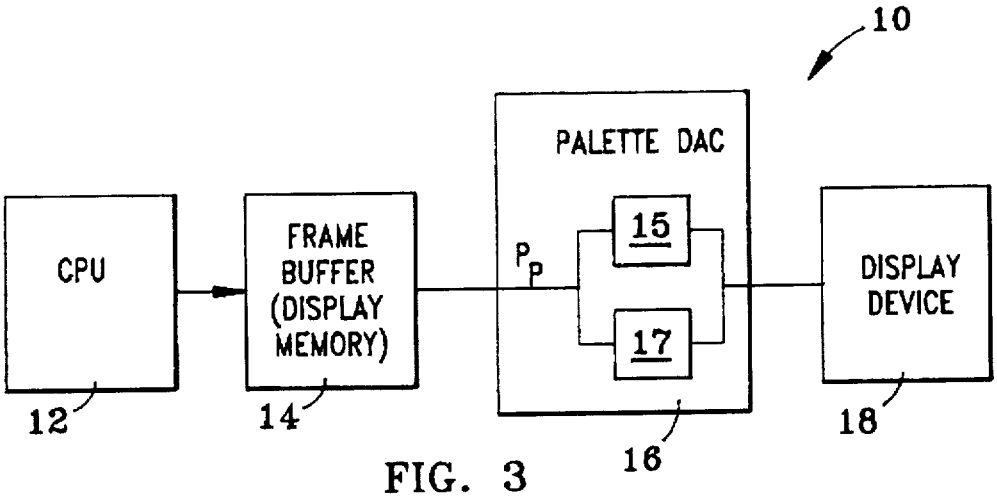
FIG. 3 is a block diagram of an advanced computer graphics system in accordance with the principles of the present invention.

The present invention will now be described with reference to FIG. 3.

A solution to the deficiencies of the prior art is to use the same port $P_p$ into the palette DAC 16 (digital to analog convertor) device from a single, common frame buffer 14 for a plurality of pixel data types. This necessitates that the palette DAC 16 distinguish the data type of each pixel received from the frame buffer in real time.

In one embodiment of the present invention, the unused most significant (bit 15) of a pixel datum having the conventional 555_RGB pixel data format is used to bit to provide a single bit "attribute" or "tag" for the 16 bpp pixel data fed to the palette DAC device 16. Thus, it is possible to distinguish the RGB pixel data type from the YUV pixel data type. In this way, both pixel data types can be fed to the palette DAC device 16 through the same port $P_p$, and the processing uniquely required for each pixel data type can be applied in the manner appropriate to each, and based on the value of bit 15. This is diagrammatically shown in Table 1.

TABLE 1

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| ≠T | | RED (5) | | | | GREEN (5) | | | | BLUE (5) | | | | | |
| =T | | Y(8) | | | | | | U/V(7) | | | | | | | |

As shown by Table 1, the bit 15 tag (T) may be defined as either 0 or 1, and the palette DAC device 16 accordingly programmed. If bit 15 of the data for a given pixel is not equal to T then that pixel is identified and processed as a pixel in the 555_RGB format, within and according to the above format. If bit 15 of the data for a given pixel is equal to T then that pixel is identified and processed as a pixel in the YUV format, within and according to the above format. After identification of the data format, each pixel datum is subsequently communicated to a real time processing circuit 15 or output channel 17 as appropriate for the data format type.

It will be seen, by comparing the disclosed format with the conventional YUV format, that the chrominance component (U/V) has been reduced from 8 bits to 7 bits. We have found that precision in the chrominance component may be preferentially sacrificed in favor of precision in the luminance component, and that the loss of one bit of precision in the chrominance component causes no perceptible deterioration in the displayed image quality for digital video or natural images.

Digital video data in the conventional "un-tagged" YUV format may be easily converted to the disclosed "tagged" format by left-shifting the data by one bit position and setting bit 15 to the defined tag value (T). This is an operation that can be easily performed by either the CPU 12, or in dedicated hardware processing the data prior to presentation to the frame buffer 14.

Graphics data in the conventional 555_RGB format requires no conversion at all, however bit 15 must be set to the complement of the defined tag value (T). Any graphics data in the 565_RGB format can be simply converted by known methods into the 555_RGB format and processed as above. Such operations on RGB pixel data can be easily performed by either the CPU 12, or in hardware, prior to presentation to the frame buffer 14.

In alternate embodiments of the present invention, any other pixel format data using 15 or less bits per pixel may be substituted for data having a 555_RGB format. The palette DAC device 16 would then be programmed to determine which pixel format to use when the most significant bit of the pixel data does not match the "Tag" value. Similarly, the "Tag" bit may be any bit within the datum describing the pixel, and the palette DAC device 16 would then be programmed accordingly.

In another alternative embodiment which relates to distinguishing between YUV and CLUT format data, one of the 256 luminance values of the 16 bpp 4:2:2 YUV format is set aside as a "key" to indicate that the chrominance byte should be interpreted as CLUT8 data indexing the color of the pixel, rather than as a component of YUV pixel data. By using a "key" value in the luminance byte to provide a means to "attribute" or "tag" the 16 bpp pixel data fed to the palette DAC device 16, it is possible to distinguish the CLUT8 pixel data type from the YUV pixel data type. In this way, both pixel data types presented to the palette DAC device 16 through the same port $P_p$, and the processing uniquely required for each pixel data type can be accomplished in an output circuit 15 or 17 appropriate to the data format, based on the value of the luminance byte. This is diagrammatically shown in Table 2.

TABLE 2

| 15 14 13 12 11 10 9 8 | 7 6 5 4 3 2 1 0 |
|---|---|
| Y ≠ LK | U/V |
| Y = LK | CLUT8 |

As shown by Table 2, the value LK may be defined as any of the possible 256 luminance values, and the palette DAC device 16 accordingly programmed. If the luminance (Y) byte for a given pixel is not equal to LK then that pixel is identified and processed, conventionally, as a pixel of the 16 bpp 4:2:2 YUV format. If the luminance (Y) byte for a given pixel is equal to LK then that pixel is identified and processed as a pixel using the CLUT8 format, with the pixel color indexed by the 8 bit value in the chrominance byte. Any value may be chosen for the value LK, or alternatively, a range of values may be selected. In an alternative embodiment, selected bits may be masked in the equality comparison to allow more than one value to be used as the "key".

Digital video data in the conventional 16 bpp digital 4:2:2 YUV format requires no conversion into the disclosed format, however if a YUV pixel is intended then the pixel data must not have a luminance byte that matches the value of LK. This is an operation that can be easily performed by either the CPU 12, or in hardware. If a LK=0 is set, then there should be no conflict with any legitimately encoded YUV Digital Video data.

Graphics data in the conventional CLUT8 format requires no conversion to the 8 bits describing the pixel, however it must be expanded to 16 bits, setting the new (higher) byte equal to the defined LK value. This operation on CLUT8 pixel data can be easily performed by either the CPU 12, or in hardware. If required, the higher byte can be set to LK either singly for each pixel or known fast fill operations can be used to set LK in a large number of bytes very rapidly, for instance in the frame buffer 14.

In yet other alternative embodiments, it is possible to substitute any other 8 bpp pixel format in place of CLUT8. For example, suitable 8 bpp pixel formats include, without limitation, 332_RGB and 8 bit, 256 level grey scale formats. Any pixel format using 8 or less bits per pixel could be used in place of CLUT8 in the present method. The palette DAC device 16 would be programmed to determine which pixel format to use when the luminance byte matches the value of LK.

In yet still other alternative embodiments, the value LK could be represented by 4 bits. Thus, it will be understood that 444_RGB format pixel data, or 12 bit CLUT format pixel data, could be distinguished from YUV format pixel data.

In yet still other alternative embodiments, in place of output channels comprising DACs, or data format conversion means, the data could be presented to one or more output channels comprising any known video device, including memory and the like.

While the present method and device have been described in terms of processing pixel data received from the frame buffer and presented to at least one DAC, it will be appreciated that the method of data format identification may be used elsewhere in a data processing system, and that a device operating according to the method may be placed at alternate architectural locations within a data processing system.

Upon a reading of the present disclosure, it will be apparent to the skilled artisan that other embodiments of the present invention beyond those embodiments specifically described herein may be made or practiced without departing from the spirit of the invention. Similarly, changes, combinations and modifications of the presently disclosed embodiments will also become apparent. The embodiments disclosed and the details thereof are intended to teach the practice of the invention and are intended to be illustrative and not limiting. Accordingly, such apparent but undisclosed embodiments, changes, combinations, and modifications are considered to be within the spirit and scope of the present invention as limited solely by the appended claims.

What is claimed is:

1. A method for identifying the format of video pixel data in a data stream, the data stream comprising video pixel data having at least a first pixel data format and a second pixel data format, the second pixel data format being a YUV format, the method comprising the steps of:

a) receiving pixel data;

b) selecting an output channel in response to at least one particular value of at least one bit of each said received pixel datum wherein the particular value identifies the data format as one of the first pixel data format and the YUV format; and c) providing said pixel data to said selected output channel, wherein the first pixel data format is a 555 RGB format, and the YUV format is a modified 4:2:2 YUV format having a reduced number of chrominance bits as compared to a conventional 4:2:2 YUV format and wherein bits 0 to 6 represent chrominance, bits 7 through 14 represent luminance, and bit 15 represents the particular value identifying the data format.

2. A method for identifying the format of video pixel data in a data stream, the data stream comprising video pixel data having at least a first pixel data format and a second pixel data format, the second pixel data format being a YUV format, the method comprising the steps of:

a) receiving pixel data;

b) selecting an output channel in response to at least one particular value of at least one bit of each said received pixel datum wherein the particular value identifies the data format as one of the first pixel data format and the YUV format; and c) providing said pixel data to said selected output channel, the first pixel data format being a 16 bpp video pixel CLUT8 format and the YUV format being a 16 bpp video pixel 4:2:2 YUV format, and wherein at least one particular value of the eight most significant bits of each video pixel datum identifies the data format as one of the group comprising 4:2:2 YUV and CLUT8.

3. The method as recited in claim 2 wherein the at least one particular value of the eight most significant bits comprises a predetermined luminance value of the YUV pixel data format.

4. A method for identifying the format of video pixel data in a data stream, the data stream comprising video pixel data having at least a first pixel data format and a second pixel data format, the second pixel data format being a YUV format, the method comprising the steps of:

a) receiving pixel data;

b) selecting an output channel in response to at least one particular value of at least one bit of each said received pixel datum wherein the particular value identifies the data format as one of the first pixel data format and the YUV format; and c) providing said pixel data to said selected output channel, wherein the first pixel format is a 16 bpp pixel data format selected from the group consisting of modified 444_RGB format and modified CLUT12 format, and the YUV format is a 16 bpp video pixel 4:2:2 YUV format, and wherein at least one particular value of the four most significant bits of each video pixel datum identifies the data format as the first pixel format or the YUV format.

5. A circuit in a video graphics device comprising:

a) a means for receiving pixel data from a data stream, the data stream comprising video pixel data having at least a first pixel data format and a second pixel data format, the second pixel data format being a YUV format;

b) a means for selecting an output channel in response to at least one particular value of at least one bit of each said received pixel datum wherein the particular value identifies the data format as one of the first pixel data format and the YUV format; and c) a means for providing said pixel data to said selected output channel, the first pixel data format being a 16 bpp video pixel CLUT8 format and the YUV format being a 16 bpp video pixel 4:2:2 YUV format, and wherein at least one particular value of the eight most significant bits of each video pixel datum identifies the data format as one of the group comprising 4:2:2 YUV and CLUT8.

6. A computer system having a video graphics device circuit comprising:

a) a means for receiving pixel data from a data stream, the data stream comprising video pixel data having at least a first pixel data format and a second pixel data format, the second pixel data format being a YUV format;

b) a means for selecting an output channel in response to at least one particular value of at least one bit of each said received pixel datum wherein the particular value identifies the data format as one of the first pixel data format and the YUV format; and c) a means for providing said pixel data to said selected output channel, the first pixel data format being a 16 bpp video pixel CLUT8 format and the YUV format being a 16 bpp video pixel 4:2:2 YUV format, and wherein at least one particular value of the eight most significant bits of each video pixel datum identifies the data format as one of the group comprising 4:2:2 YUV and CLUT8.

* * * * *